United States Patent [19]

Lillbacka et al.

[11] 4,250,607

[45] Feb. 17, 1981

[54] MACHINE FOR PRESSING HOSE COUPLINGS ONTO HOSES

[76] Inventors: Jorma Lillbacka; Esa Rintala, both of SF-62300 HärmäSuomi, Finland

[21] Appl. No.: 940,206

[22] Filed: Sep. 7, 1978

[30] Foreign Application Priority Data

Sep. 7, 1977 [FI] Finland ..... 772651

[51] Int. Cl.[3] ..... B23P 19/04

[52] U.S. Cl. ..... 29/237; 29/283.5; 72/402

[58] Field of Search ..... 29/234, 283.5, 237; 72/402

[56] References Cited

U.S. PATENT DOCUMENTS

| | | | |
|---|---|---|---|
| 2,311,662 | 2/1943 | Hunziker | 29/237 |
| 3,762,209 | 10/1973 | Herndon et al. | 29/237 |
| 3,848,451 | 11/1974 | Allin | 29/237 |
| 4,014,202 | 3/1977 | Van Allen et al. | 29/237 |
| 4,071,936 | 2/1978 | Smith | 29/237 |

*Primary Examiner*—James L. Jones, Jr.

[57] ABSTRACT

Machine for pressing hose couplings onto the ends of pressure hoses, radially from the circumference toward the center, comprising a revolving disk in which pressing tools can be detachably fastened, to be used in succession, and a pressing device opposite to which the tools are brought in turn to perform the pressing. Alternatively, a programming or a manual control device can be used with the machine for controlling the pressing operations. The disk may have a locking device and openings for attaching the tools thereto. The pressing device is preferably built with side plates, the tool in use being pressed against one of the plates. The tools preferably consist of two ring-like elements with radial jaws therebetween, possibly with working jaws that have quick-locking devices for fastening.

6 Claims, 4 Drawing Figures

MACHINE FOR PRESSING HOSE COUPLINGS ONTO HOSES

The present invention relates to a machine for pressing workpieces in the form of hose couplings onto pressure hoses and the like.

Hose-coupling pressing machines are generally known. However, they have the disadvantage that, when changing from one size of coupling and hose to another, the change of tools is a laborious and time-consuming task. Therefore, if the program of work involves the fastening of varying quantities of different couplings the job will consume unreasonable time, which will of course result in high costs in labour.

The object of the present invention is to provide a novel and efficient machine for pressing hose couplings on to hoses, with which machine it is possible to minimize the costs of secondary time and also otherwise to increase the speed of work, the working range and adjustability of the machine being as comprehensive as possible.

Another object is to bring about a machine whose quality of work is as uniform and dependable as possible, whereby a minimum of trouble would be encountered when using the products.

Figure 1:
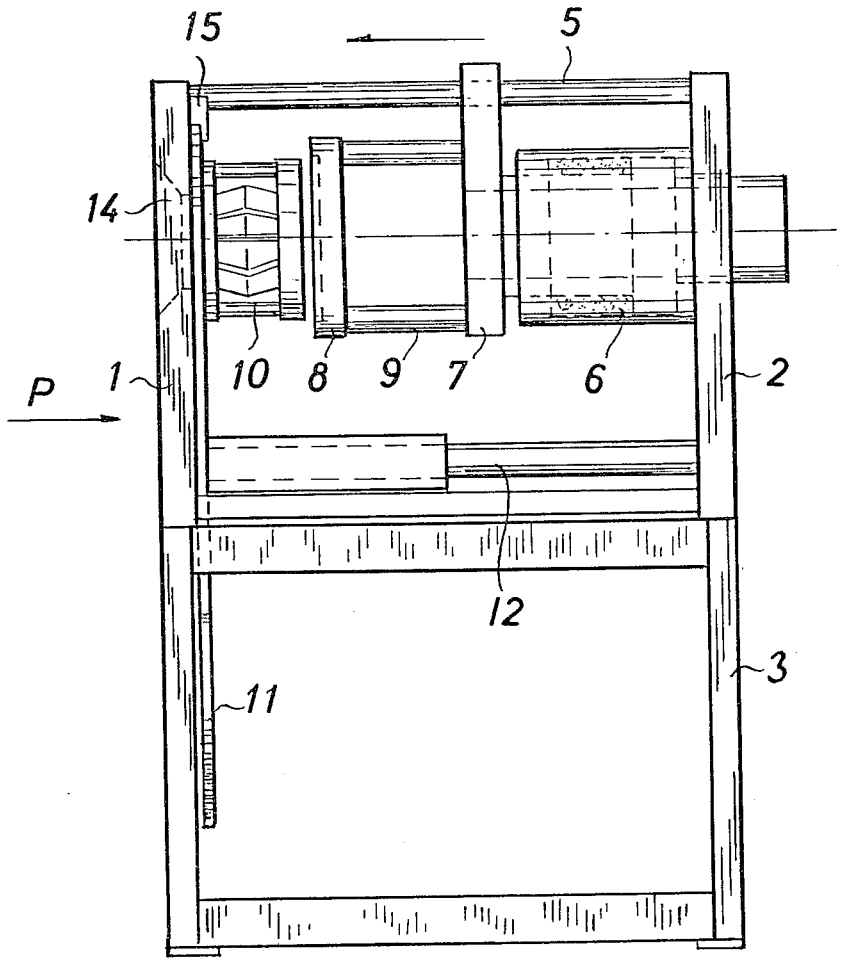
Figure 2:
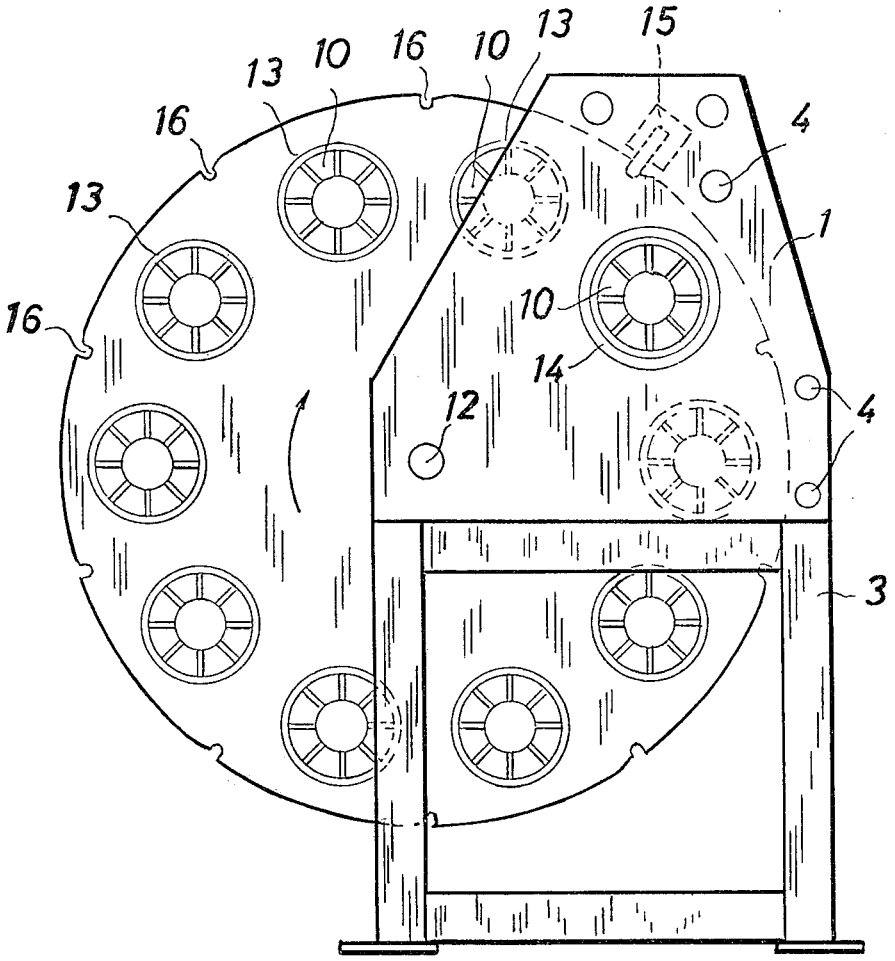
Figure 3:
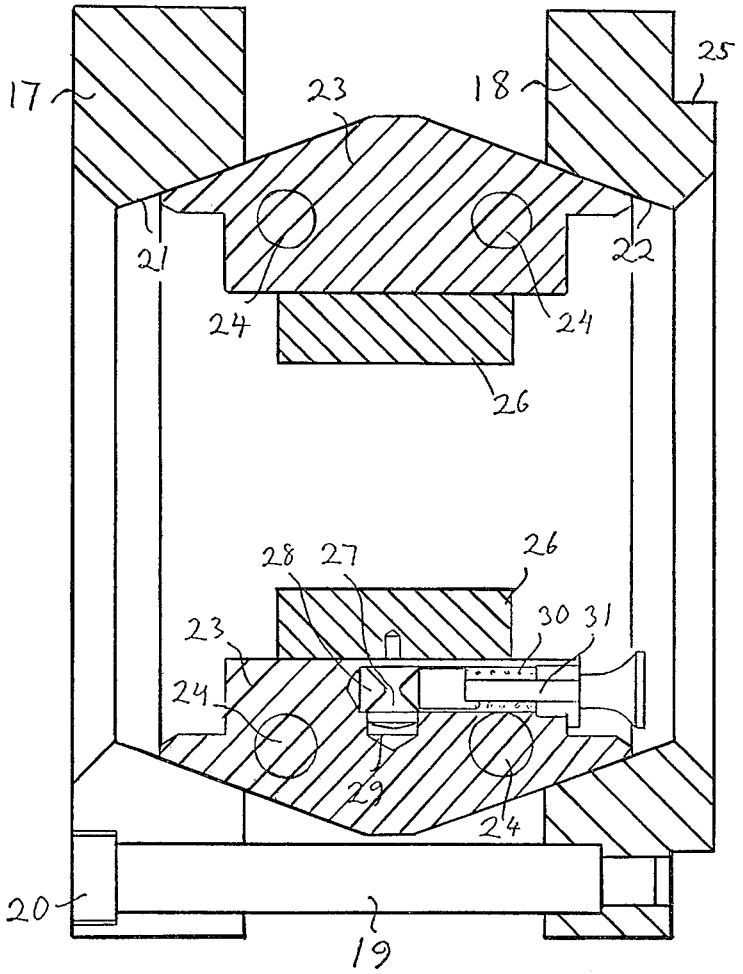

The objects of the invention are achieved by building a machine in accordance with the following description. An exemplary embodiment according to the invention is made better perceptible in the following description, with simultaneous reference to the accompanying drawings, in which FIG. 1 presents a machine in accordance with the invention, in front view;

FIG. 2 presents the machine in end view;

FIG. 3 presents a tool head, viewed from one side; and

Figure 4:
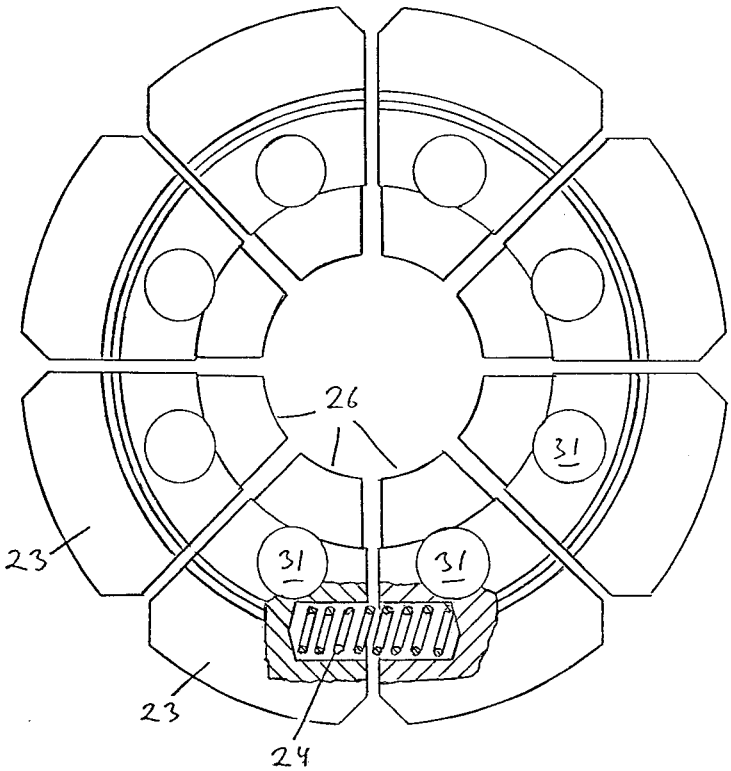

FIG. 4 is the tool head in front view.

A machine in accordance with the invention and shown in FIGS. 1 and 2 consists of a sturdy frame structure, the upper part of which at least is provided with two thick side plates 1 and 2 which are connected to a base part 3. The side plates are connected to each other by means of one or several horizontal connecting bars 4. In addition, a supporting beam 5 is fitted to connect the side plates at their upper edges and, at the same time, to act as guide for a ram of a pressing device of the machine.

Mounted in base part 3 is a hydraulic driving gear which in itself is of known construction with a requisite motor an oil reservoir and proper devices. The driving gear is not shown in the drawing.

The pressing device of the machine comprises a horizontal hydraulic cylinder 6 which is fastened to side plate 2 and is of such construction that it contains a tubular piston on account of which the centre portion of its cylinder is open, i.e. it has an axial hole. The other end of the cylinder is attached to a push carriage or push plate 7 which by running along a guide on supporting beam 5 guides the ram of the press. The ram consists of a thrust plate 8 which is secured to the push carriage by means of four bars 9 which transmit the pressing force of the cylinder by means of thrust plate 8 further to an actual pressing tool 10.

For the attachment and use of pressing tools 10 the machine is, in accordance with the invention furnished with a revolving disk 11, which is mounted on a horizontal shaft 12, which latter is fitted with bearings into side plates 1 and 2 in such a way that the disk is tangent to, or moves close to side plate 1 on the same side where the tool 10 is, and has the function of a counterpart to the pressing tool during the pressing operation. The disk 11 is provided with openings 13 with an equal pitch and same radius in respect to the centre, into each of which openings it is possible to fasten the tool 10—detachably and most suitably by means of a quick-locking device known in itself—the purpose of which tool is to secure press hose couplings on to a pressure hose by exerting radial pressure.

Side plate 1 is provided with a preferably round opening 14 which is central in respect to the pressing device and through which the couplings and the hose are placed inside the tool, onto which it is to be pressed.

The tools 10 placed into the disk 11 may each be dissimilar in so far as they are intended to be used for fastening hose couplings of different diameters and kinds onto respective hoses. Thus in this exemplified case, up to ten different sizes are feasible because the revolving disk may have room for so many pressing tools.

The basic size of the tools 10 is most suitably the same for all, and consequently, the diameter of the holes in the disk 11 should also be the same.

Additionally versatility is achieved by it being possible to change jaws of different kinds into every tool 10, which means that the setting and programming of the device for a great number of work programs of different kind can be quickly carried out.

According to the invention, the machine is arranged for automatic operation in such a way that, in accordance with a preset program, it causes the disk 11 to turn and bring the then required tool 10 to coincide with the pressing device.

To effect such program, the revolving disk 11 is provided with a mechanical drive by means of which it can be turned—in accordance with a given program—to successive different positions, thus bringing each time the requisite pressing tool 10 in its turn to a working position. For instance, an electric motor can be fitted to drive the disk by means of a gearing. The operation of the motor is goverened in a way known in itself, so that it can be programmed in advance to perform the required successive turns.

The operation of the press part is also arranged for automatic control so that in each position of the disk 11 the required number of pressings are obtained in accordance with a work program.

The disk can also be provided with an electromagnetically functioning locking device 15 which in accordance with the program locks the disk in a stationary, proper position. The locking device may have a projection (25 to be described later) which enters retaining notches or holes 16 in the periphery of the disk 11.

Connected with the programming device is also the control of the press part in such a way that the pressure is adjustable. This is done e.g. by means of a potentiometer to measure the length of the pressure stroke and which is connected electrically with programming.

Connected with the programming device is most suitably an electronic memory, known in itself, in which various programs can be stored.

The setting of the machine's tools 10 is performed in advance so as to correspond to the program to be used, the requisite pressing heads with suitable jaws being then placed in the revolving disk 11.